US005419848A

United States Patent [19]

VanEenam

[11] Patent Number: 5,419,848

[45] Date of Patent: May 30, 1995

[54] AQUEOUS DEGREASER EMULSION COMPOSITIONS

[75] Inventor: Donald N. VanEenam, Des Peres, Mo.

[73] Assignee: Buckeye International, Inc., Maryland Heights, Mo.

[21] Appl. No.: 85,077

[22] Filed: Jul. 2, 1993

[51] Int. Cl.[6] ..... C11D 7/50; C23G 5/02

[52] U.S. Cl. ..... 252/164; 252/154; 252/162; 252/173; 252/174.17; 252/174.18; 252/174.21; 252/174.23; 252/174.24; 252/541; 252/542; 252/544

[58] Field of Search ..... 252/153, 162, 165, 172, 252/173, 174.21, 174.22, 174.23, 174.24, 174.17, 174.19, DIG. 14, 164, 174.18, 174.25, 541, 542, 544

[56] References Cited

U.S. PATENT DOCUMENTS 5,080,822 1/1992 VanEenam ..... 252/170

5,080,831 1/1992 VanEenam ..... 252/558

5,158,710 10/1992 VanEenam ..... 252/539

*Primary Examiner*—P. Achutamurthy

*Attorney, Agent, or Firm*—Senniger, Powers, Leavitt & Roedel

[57] ABSTRACT

Aqueous degreaser compositions are formulated in the form of stable emulsions containing at least one sparingly water soluble organic solvent having specified compositional characteristics, a viscosifying thickener and water. The viscosifying thickener is present in an amount such that when the mixture of the organic solvent and thickener are subjected to sufficiently energetic mixing and/or shear conditions, the initially formed, unstable 2-phase agglomerate is transformed into a uniformly opaic, stable emulsion having a viscosity of at least 500 centipoise and a droplet size of approximately 0.1 to 3 millimicrons. The compositions so formulated exhibit excellent stability and degreasing efficacies.

17 Claims, No Drawings

AQUEOUS DEGREASER EMULSION COMPOSITIONS

BACKGROUND OF THE INVENTION

This invention relates to degreaser compositions and, more particularly, to stable, aqueous degreaser compositions in the form of emulsions which exhibit excellent stability and degreasing efficacies.

Heretofore, the conventional and available cleaner/-degreaser emulsion compositions have been water in oil or oil in water emulsions in which the organic solvent component is an inherently water insoluble organic solvent. Such available emulsion compositions include, for example, those marketed under the trade designations "Off" asphalt remover which contains the water insoluble solvents toluene and o-dichlorobenzene emulsified with a tall oil amide. Other available emulsion compositions contain water insoluble aromatic solvents such as xylene, kerosene, mineral spirits, benzene or naphthalene emulsified with various surfactants to form oil in water emulsions. Illustrative of such available emulsions are those marketed under the trade designations "Brulin 512M, "Spartan WRD-160", "Betco Emuisifiable Solvent Degreaser", "Amrep Jel-Sol", and "DuBois Actusol". In the preparation of such emulsions, an inherently water insoluble organic solvent, typically a hydrocarbon solvent is emulsified with one or more surfactants soluble in the solvent component. When this nonaqueous emulsion or solution is combined with water, a true milky emulsion is formed in which essentially none of the solvent component and only a relatively small amount of the surfactant component is dissolved in the aqueous phase. Thus, the cleaning/degreasing efficacy of such emulsion compositions is almost entirely derived from the nonaqueous or discontinuous phase of the emulsion containing the solvent component necessary to remove oleophilic (hydrophobic) soilants.

In my copending, co-assigned application Ser. No. 452,623 filed Dec. 19, 1989, there is disclosed improved aqueous cleaner/degreaser emulsion compositions which contain at least one sparingly water soluble organic solvent having certain characteristics, a solubilizing additive consisting of from 0.1 to 100 weight percent of a surfactant and from 0 to 99.9 weight percent of a coupler with the solubilizing additive being present in an amount insufficient to solubilize all of the total organic solvent content but sufficient to emulsify the unsolubilized portion of the total organic solvent content, and water. Such emulsion compositions contain a portion of the organic solvent component in the aqueous or continuous phase of the emulsion and the remainder of the organic solvent component in the emulsion or discontinuous phase thereby providing enhanced cleaning-/degreasing efficacies.

While the available cleaner/degreaser emulsion compositions are efficacious, a shelf/storage stable, aqueous degreaser emulsion composition which does not require the presence of surfactants or the use of petroleum hydrocarbons and which is particularly efficacious for heavy industrial degreasing would be useful in the art.

SUMMARY OF THE INVENTION

Among the several objects of the invention may be noted the provision of stable, aqueous degreaser emulsion compositions with excellent degreasing efficacy; the provision of such degreaser emulsion compositions which do not require the presence of surfactants or petroleum hydrocarbons, the provision of degreaser emulsion compositions of this type which are particularly effective for heavy industrial degreasing; the provision of such degreaser emulsion compositions which may be formulated in various forms including creams, gels and aerosol forms; and the provision of methods of preparing such degreaser emulsion compositions. Other objects and features will be in part apparent and in part pointed out hereinafter.

Briefly, the present invention is directed to stable, aqueous degreaser compositions which consist essentially of:

(a) at least one sparingly soluble organic solvent characterized by:
  (i) having a water solubility in the range of approximately 0.05 to approximately 6 weight percent;
  (ii) not being a hydrocarbon or halocarbon;
  (iii) having one or more similar or dissimilar oxygen, nitrogen, sulfur or phosphorous containing functional groups;
  (iv) being a solvent for hydrophobic soilants; and
  (v) being present in an amount exceeding its aqueous solubility;

(b) a viscosifying thickener being present in an amount such that when the mixture of said organic solvent and thickener are subjected to sufficiently energetic mixing and/or shear conditions, the initially formed, unstable, 2-phase agglomerate is transformed into a uniformly opaic, stable emulsion having a viscosity of at least 500 centipoise and a droplet size of approximately 0.1 to 3 millimicrons; and (c) water The emulsion compositions of the invention are oil in water emulsions in which the sparingly soluble organic solvent is only solubilized in the aqueous or continuous phase to the extent of its aqueous solubility with the balance of the organic solvent being in the emulsion or discontinuous phase thereby maximizing the degreasing efficacy of the organic solvent.

DESCRIPTION OF THE PREFERRED EMBODIMENTS

In accordance with the present invention, it has now been found that stable, aqueous degreaser emulsion compositions with excellent degreasing efficacy can be formulated by combining at least one sparingly water soluble organic solvent having certain compositional and solvency characteristics and being present in an amount exceeding its aqueous solubility with a viscosifying thickener and water, the viscosifying thickener being present in an amount such that when the mixture of organic solvent and thickener are subjected to sufficiently energetic mixing and/or shear conditions, the initially formed, unstable 2-phase agglomerate is transformed into a uniformly opaque, stable emulsion having a viscosity of at least 500 centipoise and a droplet size of approximately 0.1 to 3 millimicrons. The viscosifying thickener thus enables the unsolubilized portion of the organic solvent to be emulsified in the emulsion or discontinuous phase of the oil in water emulsions formed, with the solvent being solubilized in the aqueous or continuous phase to the extent of its inherent aqueous solubility limit. This in turn permits the organic solvent in both phases of the emulsion to exert its degreasing effect whereas in emulsions formulated with water insoluble hydrocarbon or halocarbon organic solvents, only the water insoluble organic solvent in the nonaqueous or discontinuous phase of the emulsions is available for degreasing.

In formulating the stable, aqueous degreaser compositions of the invention, the sparingly soluble organic solvent, viscosifying thickener and water are mixed together and, as shown by the working examples set forth hereinafter, initially form an unstable, 2-phase agglomerate which is present in the form of coalesable, unstable macroglobules. In order to convert the unstable agglomerate or macroglobules to substantially stable, oil in water emulsions having a viscosity of at least 500 centipoise and a liquid droplet size of approximately 0.1 to 3 millimicrons requires an energy input in the form of stirring, agitation or other source of turbulent flow. This transformation is generally accomplished by subjecting the initially existing agglomerate or macroglobules to sufficiently energetic mixing and/or shear conditions for a sufficient length of time to produce the desired emulsion. As shown hereinafter, this may be accomplished, for example, by vigorously stirring the agglomerate at high speed/high shear with a stirrer, motor-driven 3-bladed impellor. A change in appearance accompanies this transformation from a gross 2-phase agglomerate or mixture to one of uniformly, usually intensely white, opaque emulsion. In general, the rate of conversion from 2-phase agglomerate to emulsion is proportional to the rate and level of energy input over the transforming time required. On the basis of the working examples set forth hereinafter and principles well known to those skilled in the art of emulsification (see, for example, K. Shinoda and S. Friberg, "Emulsions and Solubilization", J. Wiley & Sons, New York, N.Y. (1986), and references cited therein; Hyman, "Mixing & Agitation", Advances in Chemical Engineering, vol. 3, Academic Press, New York, N.Y. (1962), p. 120; Perry, R. H. & Green, D. W., Perry's Chemical Engineers' Handbook, 6th Edition, Section 21, "Liquid-Liquid Systems", pp, 55–81, McGraw-Hill Book Co., New York, N.Y. (1984), and references cited therein), aqueous degreaser emulsion compositions can be readily prepared without undue experimentation.

As indicated, the degreaser emulsions formulated in accordance with the invention should have a viscosity of at least 500 centipoise and preferably a viscosity within the range of approximately 500 to 10,000 centipoise. Higher viscosities, on the order of approximately 15,000 to 100,000 may be acceptable where the emulsions are produced in the form of usable pastes and gels, for example, The viscosities referred to herein are Brookfield viscosities as determined in the working examples set forth hereinafter.

It is to be noted that, in accordance with the invention, stable, aqueous degreaser emulsions may be formulated without the use of surfactants and/or couplers as required with the cleaner/degreaser emulsions disclosed in my copending, co-assigned application Ser. No. 452,623. As used herein, the term "degreaser" generally refers to an emulsion composition devoid of any surfactant or detergent component. However, as illustrated in certain of the working examples set forth hereinafter, low levels of compatabilizing agents constituted by surfactants or couplers may be incorporated in the emulsions with the viscosifying thickener to assist, initiate or promote the transformation from the initially formed, 2-phase agglomerate or macroglobules to emulsion. The level of compatabilizing agent utilized for this purpose is very low, generally on the order of approximately 0.3% by weight or less, and is far below the amounts required to produce the cleaner/degreaser emulsions disclosed in my copending application Ser. No. 452,623. Such compatabilizing agents do not produce stable emulsions but assist or help in the transforming process from agglomerate to emulsion in those instances where extended mixing and/or shear conditions prove to be insufficient to effect the necessary transformation.

For use in the present invention, the sparingly water soluble organic solvent must have the following characteristics:

(a) it must have limited water solubility in the range of approximately 0.05 to 6 weight percent;
(b) it must not be a hydrocarbon or halocarbon;
(c) it must have one or more similar or dissimilar oxygen, nitrogen, sulfur or phosphorous containing functional groups;
(d) it must be a solvent for hydrophobic soilants; and
(e) it must be present in an amount exceeding its limited aqueous solubility.

Preferably, the organic solvent has a water solubility in the range of approximately 0.05 to approximately 2.5 weight percent, more preferably between 1 and 2.5 weight percent. Organic solvents meeting these criteria provide superior cleaning/degreasing action when formulated in accordance with the invention.

The principal classes of organic solvents from which useful organic solvents may be selected include esters, alcohols, ketones, aldehydes, ethers and nitiles. These will generally contain one or more of the desired similar or dissimilar functional groups listed above. Examples of organic solvents containing similar functional groups from among those listed above include diethyl gluterate (2 ester groups), phenacyl acetone (2 keto groups), diethylethylene diphosphonate (2 phosphonate ester groups), ethylenedipropionate (2 ester groups), decylene glycol (2 hydroxyl groups), m-dimethoxybenzene (2 ether groups), adiponitrile (2 nitrile groups), ethylene glycol dibutyl ether (2 ether groups), and diethyl-o-phthalate (2 ester groups). Among organic solvents containing dissimilar functional groups from among those listed above may be mentioned 2-phenoxyethanol (hydroxy, ether groups), 1-phenoxy-2-propanol (hydroxy, ether groups, N-phenylmorpholine (amino, ether groups), isopropylacetoacetate (keto, ester groups), o-methoxybenzyl alcohol (ether, hydroxy groups), 4-methoxyacetophenone (ether, ketone groups), o-nitrophenetol (nitro, ether groups), 2-hexoxyethanol (hydroxy, ether groups), ethylcyano-acetoacetate (cyano, keto, ester groups), p-anisaldehyde (ether, aidehyde groups), polypropylene glycol 1200, 2000, and 4000 (ether, hydroxyl groups), n-butoxy acetate (ether, ester groups), and 2-phenylthioethanol (thioether, hydroxyl groups).

In addition to the criteria listed above, it is also desirable but not essential that the organic solvent have a relatively low volatility or high flash point, exhibit a low level of odor, be chemically stable, nontoxic, nonhazardous, liquid or easily liquified at ambient temperatures, and commercially available.

The sparingly water soluble organic solvents which may be employed in the practice of the present invention (and comprising some of the solvents listed above) together with their aqueous ambient temperature solubility in wt.% include 2-phenoxyethanol (2.3) (marketed under the trade designation "Dowanol EPh"), 1-phenoxy-2-propanol (1.1) (marketed under the trade designation "Dowanol PPh"), β-phenylethanol (1.6) acetophenone (0.5), benzyl alcohol (4.4), benzonitrile (1.0), n-butyl acetate (0.7), n-amyl acetate (0.25), benzaldehyde (0.3), N,N-diethylaniline (1.4), diethyl adipate (0.43), dimethyl-o-phthalate (0.43), n-amyl alcohol (2.7), N-phenylmorpholine (1.0), n-butoxyethyl acetate (EB acetate) (1.1), cyclohexanol (4.2), polypropylene glycol 1200 (2), dipropylene glycol mono-n-butyl ether (Dowanol DPnB) (5.0), cyclohexanone (2.3), isophorone (1.2), methylisobutyl ketone (2.0), methylisoamyl ketone (0.5), tri-n-butylphosphate (0.6), 1-nitropropane (1.4), nitroethane (4.5), dimethyl esters of mixed succinic, glutaric and adipic acids (5.7) (marketed under the trade designation "DBE ester" by DuPont), diethyl glutarate (0.88), diethyl malonate (2.08), polyoxyalkylene polyols (e.g., polyoxypropylene diols and trioIs) such as the polypropylene glycols P1200, P2000 and P4000 (Dow Chemical), polypropylene glycol monobutyl ether (Dow Polyglycol L-1150) and polyglycol copolymers containing ethenoxy and propenoxy units (Dow 112-2). As will be apparent to those skilled in the art, the above-listed sparingly water soluble organic solvents are merely illustrative and various other solvents meeting the criteria set out above may also be utilized in the practice of the invention. Because of their performance characteristics, lack of odor, low volatility/high flash point, chemical stability and availability, 2-phenoxyethanol and 1-phenoxy-2-propanol are the preferred organic solvents of choice. N-butoxyethyl acetate (EB acetate) and the dimethyl esters of mixed succinic, glutaric and adipic acids are also among the preferred organic solvents. For emulsions of the invention in the form of lotions and creams, the use of oligomeric, hydrophobic solvents having limited aqueous solubility and molecular weights of up to 5000, preferably below 4000, are preferred since they also function as emollients, lubricants, humectants, and skin conditioners and do not defat the skin. Such solvents include polypropylene glycols (e.g., Dow P2000, PPG-20, 26 and 30), poly(1,2-butylene glycol), poly(2,3-butylene glycol), poly(norbornane oxide glycol), poly(styrene oxide glycol), poly(phenylglycidyl ether glycol), poly(isobutylglycidyl ether glycol), poly(methylglycidyl ether glycol), phenoxypolypropylene glycol, butoxypolypropylene glycol (PPG-14 butyl ether), polypropylene glycol butyl ether (PPG-18 butyl ether), polyoxypropylene n-butyl ether, polytetramethylene ether glycol, poly(tetrahydrofuran), poly(ethyl vinyl ether), poly(isobutyl vinyl ether), poly(diallyl ether), polyoxypropylene (30) trimethylpropanetriol, poly[propylene oxide (10)/phenylglycidyl ether (10) glycol], and similar solvents known to the art.

As indicated, a number of otherwise potent organic solvents having an aqueous solubility of less than approximately 0.05 weight percent, and organic solvents having an aqueous solubility in excess of approximately 6 weight percent such a propylene glycol monomethyl ether acetate (aq. sol. 16.5 wt. %), ethylene glycol diacetate (aq. sol. 14.3 wt. %), propylene carbonate (aq. sol. 19.6 wt. %) and N-methyl pyrrolidone (infinite aq. sol.) are not useful in the practice of the invention.

As indicated, the viscosifying thickener must be present in the emulsion compositions of the invention in an amount such that when the mixture of organic solvent and thickener are subjected to sufficiently energetic mixing and/or shear conditions, the initially formed, unstable, 2-phase agglomerate is transformed into a uniformly opaic, stable emulsion having a viscosity of at least 500 centipoise and a droplet size of approximately 0.1 to 3 millimicrons. Illustrative viscosifying thickeners which may be used in the practice of the invention include acrylic acid/alkyl methacrylate copolymers (Acrysol ICS-1 or Acusol 820), carboxy acrylic polymers (Carbopol 940), guar gums, xanthan gums, hydroxyethyl cellulose, hydroxpropyl cellulose, hydroxypropylmethyl cellulose, carboxymethyl cellulose, sodium carboxymethyl cellulose, bentonite clays, magnesium aluminum silicates (Magnabrite S), polyethyl ene glycols, polyethylene oxide, fumed silica, polyacrylic acid crosslinked with polyalkenyl polyethers, polyacrylamide, polyvinylpyrrolidone, poly(methylvinyl ether/maleic) anhydride, polyacrylic acids, copolymers and latex emulsions, vinyl ether/maleic anhydride copolymers, styrene/maleic anhydride copolymers, poly(acrylamidop ropane sulfonic acid), polyvinyl alcohol, partially hydrolyzed polyvinyl acetate, poly(-naphthylene sulfonic acid/formalde-hyde condensate, sodium salt), ammonium alginate and sodium alginate. Other viscosifying thickeners known to the art may also be used. The preferred thickeners include the cellulose thickeners, carboxy acrylic polymers (with and without cross-linkers), hydro-colloidal clays, silicas and related inorganic thickeners, and polyethylene oxide. Where the viscosifying thickener is one which contains free acidic groups (e.g. Acusol 820, Carbopol 940 and Magnabrite S), a neutralizing base such as sodium or potassium hydroxide, mono-, di-, or triethanolamine or other neutralizing base is incorporated to ionize or neutralize the free acid groups and produce the full thickening effect to the thickener component.

Where a compatabilizing agent is included in the emulsion compositions for the purpose discussed above, any of the surfactants or couplers disclosed in my U.S. Pat. No. 5,080,831 dated Jan. 14, 1992 may be used. The preferred compatabilizing agents include sodium octane-1-sulfonate, sodium 2-ethylhexyl sulfate, isostearamide diethanolamide, dodecylbenzenesulfonic acid and tall oil fatty acid.

Various optional adjuvants can also be incorporated into the degreaser emulsions of the invention. These include chelants such as the sodium salts of ethylenediaminetetraacetic acid (Hampene 100 or Versene 100), defoamers and foam controlling agents, fragrances, dyes, preservatives, buffers, lubricants, emollients, pH adjustants, dispersants, abrasives, anti-corrosion additives and anti-rust additives. Also, as shown by a working example hereinafter, the emulsion compositions of the invention may be prepared in aerosol form.

In general, there are practical limits with regard to the levels of solvents which may be employed in the practice of producing the stable, aqueous emulsion compositions of the invention. As illustrated by the working examples, the maximum level is generally in the range of approximately 25–30% by weight; it may be lower in the case of a ready-to-use emulsion composition. If the solvent content is raised above approximately 25–30% by weight, the number of solvent droplets per cubic volume increases to the point that the increasing rate of coalescence or reagglomerization produces a composition of unacceptably short shelf life stability.

With respect to the viscosifying thickener component of the emulsion compositions of the invention, hydrocolloidal thickeners such as those employed in the working examples set forth hereinafter may be either inorganic or organic in nature, carrying functional groups which associate with each other, with the organic solvent, or with water comprising or contained in the resultant emulsion. The viscosifying power of such thickeners can vary greatly with structure, especially, for example, with organopolymer molecular weight. In addition to greatly reduced or impeded mobility of the emulsified solvent through the thickened, continuous aqueous phase, it is believed that intermolecular interaction between thickener and polar functional group-containing solvent may possibly further promote emulsion stabilization. Generally, the level of viscosifying thickener required to reach the minimum emulsion viscosity of 500 centipoise is from approximately 0.1–10 wt. %, with the more effective higher molecular weight (up to approximately 5,000,000–6,000,000 molecular weight) organopolymers requiring levels of approximately 0.1–1.0 wt. %. This is particularly true for water dilutable viscosifier thickened degreaser emulsion concentrates. Ready-to-use compositions, such as those employed in aerosol form, will often require thickener levels of from approximately 0.1–0.25 wt. %.

With the ranges of proportions of solvent and thickener defined, the remainder of the emulsion composition is, for the most part, water. Of course, as indicated, minor levels of optional adjuvants may make up the balance of the compositions.

The concentration of the aqueous degreaser emulsion compositions, as indicated by the terms "total solids content" and "total actives content" in the working examples provided hereinafter refers, respectively, to the combined percentages of nonvolatile components and to the sum total of nonaqueous volatile and nonvolatile components.

The following examples illustrate the practice of the invention.

EXAMPLE 1

In the following examples of illustrative degreaser emulsion composition of the present invention, the compositions were subjected as indicated to the definitive, semiquantitative degreasing test method described below in order to measure their degreasing efficacy.

A magnetic stirrer (Fisher Scientific Co., Catalog No. 14-511-1A) provided with a vaned disc magnetic stir bar ($\frac{7}{8}$" (diameter)×$\frac{1}{8}$" (height), 22 mm×15 mm, Fisher Scientific Co., Catalog No. 14-511-98C) was used. In each instance, pre-cleaned, borosilicate glass microslides (3"×1", 1.0 mm thickness) were thinly smeared/-rub-on coated with Vaseline brand white petroleum jelly on one side only to a distance of 1.0 " from the bottom edge to provide a 1.0"×1.0" coated area. The test degreaser emulsions were employed at full strength unless otherwise indicated and in an amount sufficient to fill a 50 ml Pyrex beaker containing the vaned disc magnetic stirrer bar to a level of 40 ml. Each test emulsion and surrounding air were maintained at 21°±0.5° C. and the test emulsion stirring rate was determined by a setting of "3" on the stirrer dial of the magnetic stirrer. The stirring disc was positioned off-center to accommodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test aqueous/degreasing fluid at the indicated concentration, placed atop the magnetic stirrer plate, and positioned off-center to accommodate the glass microslide, and yet allow the vaned disc stirrer bar to rotate or spin freely. The stirrer was turned on, the dial adjusted manually to the "3" stirring rate setting and the Vaseline thin film coated glass microslide was introduced into the test aqueous degreasing bath in such a manner that the coated side faced upward and was positioned away from the stirrer bar. The time "0" was noted immediately on a watch or clock with a sweep second hand.

At appropriate time intervals, the glass microslide was briefly removed from the aqueous degreaser bath and immediately "read" for "% Vaseline removed from the 1.0"×1.0" treated area", an objective determination, after which the microslide was immediately returned to the stirred aqueous degreaser bath. The duration of the degreasing test is determined by the time needed for complete, 100% removal of the Vaseline film from the glass microslide surface.

The accuracy of the above-described test method is of the order of ±5% as determined by replicate run averaging.

EXAMPLE 2

An aqueous degreaser emulsion formulation was prepared having the following composition:

| Component | Wt. % |
|---|---|
| 1-Phenoxy-2-propanol (Dowanol PPh) | 20.0 |
| Acrysol ICS-1, 30% total solids | 1.5 |
| Triethanolamine | 0.5 |
| Soft $H_2O$ | 78.0 |
| | 100.0 |

The 1-phenoxy-2-propanol, Acrysol thickener and water were pre-emulsified under high shear stirring conditions. The triethanolamine was then added very slowly with vigorous stirring to thicken/emulsify the pre-emulsified mixture, and the resulting mixture was stirred for 2 minutes under high shear conditions to fully emulsify the formulation. The resulting composition was an intensely bluish-white emulsion having a pH of 7.42, a Brookfield viscosity (LV-#4 spindle, 12 rpm) of 4350 centipoise, a total solids content (theory) of 0.95%, and a total actives content (theory) of 20.95%. The emulsion exhibited no flash point and was found to be stable.

At a 1:10 dilution with water, an emulsion/microemulsion formed which very easily, totally and quickly removed the following markings from alkyd enameled metal surfaces: black, indelible Magic Marker felt pen, blue and black indelible ballpoint pens, #1 hardness pencil, red (wax) crayon and automotive grease smearings.

The above-formed emulsion/microemulsion was subjected to the degreasing test method of Example 1 with the following results:

1st attack on greased slide at <1 sec.

100% removal of grease at 18 sec.

EXAMPLE 3

An aqueous degreaser emulsion formulation was prepared having the following composition:

| Component | Wt. % |
|---|---|
| 1-Phenoxy-2-propanol (Dowanol PPh) | 15.00 |
| Carbopol 940 (0.15% in $H_2O$) | 84.90 |
| Monoethanolamine | 0.05 |
| Sodium xylene sulfonate (40%) | 0.05 |
| | 100.00 |

The procedure described in Example 2 was followed, the 1-phenoxy-2-propanol and Carbopol thickener in water being pre-emulsified under the high shear stirring conditions. The monoethanolamine and sodium xylene sulfonate were then added very slowly with vigorous, high shear stirring for 5 minutes thereafter. The resulting composition was an intensely white emulsion having a pH of 5.78, a Brookfield viscosity (LV-#3 spindle, 12 rpm) of 3000 centipoise, a total solids content (theory) of 0.197%, and a total actives content (theory) of 15.2%. The emulsion exhibited no flash point and was found to be stable.

At a 1:5 dilution with water, the formulation remained in emulsion form and very readily, easily and totally removed the following markings from alkyd enameled metal surfaces: black, indelible Magic Marker felt pen, blue and black indelible ballpoint pen, #1 hardness pencil, red (wax) crayon and automotive grease smearings.

The emulsion, at the 1:5 dilution with water, was subjected to the degreasing test method of Example 1 with the following results:

1st attack on greased slide at 1 sec.
60% removal of grease at 10 sec.
100% removal of grease at 20 sec.

EXAMPLE 4

An aqueous degreaser emulsion formulation was prepared having the following composition:

| Component | Wt. % |
|---|---|
| 2-Phenoxyethanol (Dowanol EPh) | 15.00 |
| Poly(acrylamidopropane sulfonic acid) [Rheothik 80-11], 15% in water | 15.00 |
| Monoethanolamine | 1.25 |
| Soft $H_2O$ | 68.75 |
| | 100.00 |

The components were emulsified under high shear stirring conditions for 5 minutes to produce a slightly white colored emulsion having a pH of 10.11 and a Brookfield viscosity (LV-#3 spindle, 12 rpm) of 1400 centipoise. The emulsion exhibited no flash point and was found to be stable.

At a 1:5 dilution with water, a slightly hazy, viscous solution/emulsion formed which removed the following markings from alkyd enameled metal surfaces with some difficulty and with the following results:

| Marking | % Removal |
|---|---|
| Black indelible Magic Marker felt pen | 95% |
| Black indelible ballpoint pen | 75–80% |
| Blue indelible ballpoint pen | 100% |
| #1 Hardness pencil | 100% |
| Red (wax) crayon | 90% |

The above viscous solution/emulsion was subjected to the degreasing test method of Example 1 with the following results:

1st attack on greased slide at 3 sec.
30% removal of grease at 15 sec.
70% removal of grease at 30 sec.
100% removal of grease at 45 sec.

It was noted that the viscous nature of the solution/emulsion slowed down the stirring rate and resulted in longer degreasing times.

EXAMPLE 5

An aqueous degreaser emulsion formulation was prepared having the following composition:

| Component | Wt. % |
|---|---|
| 1-Phenoxy-2-propanol (Dowanol PPh) | 20.0 |
| Polyethylene oxide, 1.0% solution in soft $H_2O$ (M.W. = 5,000,000) | 79.0 |
| Sodium 1-octanesulfonate, 40% aq. sol'n. (Bio Terge PAS-8S, 40%) | 1.0 |
| | 100.0 |

The components were emulsified under high shear using a stirrer driven by a high speed motor. The resulting composition was an intensely bluish-white emulsion having a pH of 6.78, a Brookfield viscosity (LV-#3 spindle, 12 rpm), of 1350 centipoise, a total solids content (theory) of 1.19% and a total actives content (theory) of 21.19%. The emulsion exhibited no flash point and was found to be stable.

At a 1:10 dilution with water, an emulsion/microemulsion formed which easily, totally and quickly removed the following markings from alkyd enameled metal surfaces: black indelible Magic Marker felt pen, blue and black indelible ballpoint pens, #1 hardness pencil, red (wax) crayon and automotive grease smearings.

The above emulsion/microemulsion was subjected to the degreasing test method of Example with the following results:

1st attack on greased slide <1 sec.
100% removal of grease at 15 sec.

EXAMPLE 6

An aqueous degreaser emulsion formulation was prepared having the following composition:

| Component | Wt. % |
|---|---|
| 1-Phenoxy-2-propanol (Dowanol PPh) | 20.0 |
| Sodium 2-ethylhexyl sulfate, 40% aq. sol (Niaproof 08) | 1.0 |
| Magnabrite S (magnesium aluminum silicate) in deionized water (3.0 wt % dispersed in water) | 79.0 |
| | 100.0 |

The Magnabrite S was vigorously stirred into water and the resulting colloidal suspension was stirred for 1 hour at 21° C. The three components were emulsified under high shear stirring for 5 minutes. The resulting composition was a light, buff- colored, suspension/emulsion having a pH of 9.24, a Brookfield viscosity (LV-#3 spindle, 12 rpm) of 4200 centipoise, a total solids content (theory) of 2.77% and a total actives content (theory) of 22.77%. The emulsion exhibited no flash point and was found to be stable.

At a 1:10 dilution with water, the emulsion/suspension which resulted was found to effect fast and total removal of the same markings listed in Example 5 from alkyd enameled metal surfaces.

The diluted emulsion/suspension was subjected to the degreasing test method of Example 1 with the following results:

1st attack on greased slide at 2 sec.
50% removal of grease at 10 sec.
90–95% removal of grease at 20 sec.
100% removal of grease at 25 sec.

EXAMPLE 7

An aqueous degreaser emulsion formulation was prepared having the following composition:

| Component | Wt. % |
|---|---|
| Butyl cellosolve acetate (EB acetate) | 20.0 |
| Acrysol ICS-1, 30% total solids | 1.5 |
| Soft $H_2O$ | 78.1 |
| Triethanolamine | 0.4 |
| | 100.0 |

The butyl cellosolve acetate, Acrysol thickener and water were emulsified under high shear stirring conditions. The triethanolamine was then added slowly with vigorous stirring to thicken/emulsify the mixture. The resulting composition was an intensely bluish/white emulsion having a pH of 7.20, a Brookfield viscosity (LV-#3 spindle, 12 rpm) of 5500 centipoise, a total solids content (theory) of 0.85% and a total actives content (theory) of 20.85%. The emulsion exhibited no flash point and was found to be stable.

At a 1:10 dilution with water, a bluish microemulsion formed which removed 100% of the following markings from alkyd enameled metal surfaces: blue and black indelible ballpoint pens, #1 hardness pencil and red (wax) crayon. It also removed 90% of a black indelible Magic Marker felt pen marking from the same surface.

The above-noted microemulsion was subjected to the degreasing test method of Example 1 with the following results:

1st attack on greased slide at 1–2 sec.
55–60% removal of grease at 10 sec.
100% removal of grease at 20 sec.

EXAMPLE 8

An aqueous, 0.50% solution of Kelzan S guar gum in water was prepared by slowly adding the guar gum to stirred water at room temperature. The mixture was vigorously stirred for 2 hours at room temperature to hydrocolloidally dissolve the guar gum, and the resulting solution had a Brookfield viscosity (LV-#3 spindle, 12 rpm) of 2100 centipoise.

An aqueous degreaser emulsion formulation was prepared having the following composition:

| Component | Wt. % |
|---|---|
| 2-Phenoxyethanol (Dowanol EPh) | 15.0 |
| Sodium cumene sulfonate, 45% | 2.0 |
| 0.50% Kelzan S in $H_2O$ | 83.0 |
| (prepared as above described) | |
| | 100.0 |

The components were emulsified under high shear stirring for 3–4 minutes. The resulting composition was a creamy, white emulsion having a pH of 6.76, a Brookfield viscosity (LV-#3 spindle, 12 rpm) of 2500 centipoise, a total solids content (theory) of 1.32% and a total actives content (theory) of 16.32%. The emulsion exhibited no flash point and was found to be stable.

At a 1:5 dilution with water, a hazy solution was formed which removed the following markings from alkyd enameled metal surfaces with the following results:

| Marking | % Removal |
|---|---|
| Black indelible Magic Marker felt pen | 95% |
| Red (wax) crayon | 90% |
| Blue and black indelible ballpoint pens | 100% |
| #1 Hardness pencil | 100% |

The above-noted hazy solution was subjected to the degreasing test method of Example 1 with the following results:

1st attack on greased slide at 2 sec.
33% removal of grease at 15 sec.
75–80% removal of grease at 30 sec.
100% removal of grease at 40 sec.

The degreasing rate was slowed somewhat by the viscous nature of the degreasing solution.

EXAMPLE 9

An aqueous degreaser aerosol emulsion formulation was prepared having the following composition:

| Component | Wt. % |
|---|---|
| Deionized $H_2O$ | 87.30 |
| Sodium Nitrite | 0.15 |
| Ammonium hydroxide (28% $NH_3$) | 0.05 |
| Emulsion of Example 2 | 12.50 |
| | 100.00 |

The above composition was aerosolized in a 6 oz. aerosol can using 8.32 g (15.0 ml.) of a propane-isobutane blend propellant (sold under the trade designation A-55) introduced under nitrogen gas pressure through an AR-75 valve. The fill ratio was 87/13. The valve was fitted with a Marc-18-1525 actuator.

It was found that the resulting aerosol formulation effected excellent and complete removal of the markings listed in Example 2 from alkyd enameled metal surfaces.

EXAMPLE 10

A 0.75 wt. % colloidal solution of hydroxyethyl cellulose (marketed under the trade designation Natrosol 250 HR by Aqualon Co.) in soft water was prepared by adding the requisite amount of hydroxyethyl cellulose powder to vigorously stirred, ambient temperature water. The stirring was continued for 1 hour during which the powder dissolved and the colloidal solution thickened. Finally, the colloidal solution was inhibited against bacterial and fungal growth by the addition of 0.005 wt. % Dowcil 75 preservative (Dow Co.) with stirring. The Brookfield viscosity (LV-#3 spindle, 30 rpm) of the colloidal solution was 660 centipoise and it had a pH of 8.27.

An aqueous degreaser emulsion formulation was prepared having the following composition:

| Component | Wt. % |
|---|---|
| β-phenylethanol | 15.0 |
| Hydroxyethyl cellulose 0.75% colloidal solution, prepared as above | 85.0 |
| | 100.0 |

The above mixture was placed in a 150 ml. beaker and vigorously stirred at full speed with a stirrer, motor driven 3-bladed impeller for 30 min. at room temperature. The resulting composition was an intensely white emulsion having a pH of 7.04, a Brookfield viscosity (LV-#2 spindle, 30 rpm) of 815 centipoise, a total solids content (theory) of 0.64% and a total actives content (theory) of 15.64%. The emulsion exhibited no flash point and had excellent stability.

At a 1:5 dilution with water, a bluish white emulsion formed which effected 100% removal of the markings listed in Example 8 from alkyd enameled metal surfaces.

The bluish white emulsion was subjected to the degreasing test method of Example 1 with the following results:

1st attack on greased slide at 1 sec.
35% removal of grease at 10 sec.
60–65% removal of grease at 20 sec.
90% removal of grease at 30 sec.
100% removal of grease at 35 sec.

EXAMPLE 11

A 1:00 wt. % colloidal solution of hydroxyethyl cellulose was prepared as described in Example 10 and had a Brookfield viscosity (LV-#3 spindle, 30 rpm) of 1500 centipoise and a pH of 8.48.

An aqueous degreaser emulsion formulation was prepared having the following composition:

| Component | Wt. % |
|---|---|
| β-phenylethanol | 15.0 |
| Hydroxyethyl cellulose 1.00% colloidal solution, prepared as above | 85.0 |
| | 100.0 |

The components were mixed as described in Example 10 and the resulting composition was an intensely white emulsion having a pH of 7.23, a Brookfield viscosity (LV-#2 spindle, 6 rpm) of 3150 centipoise, a total solids content (theory) of 0.85% and a total actives content (theory) of 15.85%. The emulsion exhibited no flash point and had excellent stability.

At a 1:5 dilution with water, a bluish white emulsion formed which effected 100% removal of the markings listed in Example 8 from alkyd enameled metal surfaces.

The bluish white emulsion was subjected to the degreasing test method of Example 1 with the following results:

1st attack on greased slide at 1 sec.
33% removal of grease at 10 sec.
55–60% removal of grease at 20 sec.
80% removal of grease at 30 sec.
100% removal of grease at 43 sec.

EXAMPLE 12

A 1.25 wt. % colloidal solution of hydroxyethyl cellulose was prepared as described in Example 10 and had a Brookfield viscosity (LV-#3 spindle, 30 rpm) of 3340 centipoise and a pH of 8.69.

An aqueous degreaser emulsion formulation was prepared having the following composition:

| Component | Wt. % |
|---|---|
| β-phenylethanol | 15.0 |
| Hydroxyethyl cellulose 1.25% colloidal solution, prepared as above | 85.0 |
| | 100.0 |

The components were mixed as described in Example 10 and the resulting composition was a creamy white emulsion having a Brookfield viscosity (LV-#3 spindle, 12 rpm) of 6120 centipoise, a total solids content (theory) of 1.06% and a total actives content (theory) of 16.06%. The emulsion exhibited no flash point and had excellent stability.

At a 1:5 dilution with water, a bluish white emulsion formed which effected 100% removal of the marking listed in Example 8 from alkyd enameled metal surfaces.

The bluish white emulsion was subjected to the degreasing method of Example 1 with the following results:

1st attack on greased slide at 1–2 sec.
25–30% removal of grease at 10 sec.
45% removal of grease at 20 sec.
65% removal of grease at 30 sec.
80% removal of grease at 40 sec.
90–95% removal of grease at 50 sec.
100% removal of grease at 55 sec.

EXAMPLE 13

An aqueous degreaser emulsion formulation was prepared having the following composition:

| Component | Wt. % |
|---|---|
| 1-Phenoxy-2-propanol (Dowanol PPh) | 15.00 |
| Carbopol 940 (0.20% in water) | 84.95 |
| Triethanolamine | 0.05 |
| | 100.00 |

The 1-phenoxy-2-propanol and Carbopol 940 thickener in water were pre-emulsified at high shear with vigorous stirring for 30 minutes using a full speed, 3-bladed impellor. The triethanolamine was then added dropwise with vigorous, high speed/shear stirring followed by 15 minutes of stirring to fully emulsify the formulation. The resulting composition was an intensely white emulsion having a pH of 5.02, a Brookfield viscosity (LV-#4 spindle, 60 rpm) of 8300 centipoise, a total solids content (theory) of 0.22% and a total active content (theory) of 15.22%. The emulsion exhibited no flash point and had excellent stability.

At a 1:5 dilution with water, the resulting emulsion effected 100% removal of the markings listed in Example 8 from alkyd enameled metal surfaces.

The diluted formulation was subjected to the degreasing test method of Example 1 with the following results:

1st attack on greased slide at 1 sec.
55–60% removal of grease at 10 sec.
90% removal of grease at 20 sec.
100% removal of grease at 25 sec.

EXAMPLE 14

A 1.80 wt. % colloidal solution of hydroxypropylmethyl cellulose (Methocel J5MS, Dow Chemical Co.) was prepared using distilled water according to a suggested solution technique given by Dow. The requisite amount of hydroxypropylmethyl cellulose powder thickener was added to stirred water. Sufficient ammonium hydroxide was then added dropwise to the resultant aqueous dispersion, under continued stirring conditions, until a pH of 8.75 was attained. Stirring was continued for a period of 1 hour and finally the resulting solution was inhibited by the addition of 0.005% Dowcil 75 preservative with stirring to achieve dissolution. The resultant clear colloidal solution had a Brookfield viscosity (LV-#3 spindle, 30 rpm) of 2600 centipoise and a pH of 8.75.

An aqueous degreaser emulsion formulation was prepared having the following composition:

| Component | Wt. % |
|---|---|
| Acetophenone | 10.0 |
| Hydroxypropylmethyl cellulose (1.80%) prepared as above | 90.0 |
| | 100.0 |

The above mixture was placed in a 150 ml. beaker and stirred vigorously at full speed with a high speed stirrer, motor-driven 3-bladed impellor for 30 minutes at room temperature. The resulting composition was an intensely white emulsion having a pH of 8.59, a Brookfield viscosity (LV-#3 spindle, 30 rpm) of 3140 centipoise, a total solids content (theory) of 1.62% and a total actives content (theory) of 11.62%. The emulsion exhibited no flash point and had excellent stability.

At a 1:5 dilution with water, a bluish-white emulsion formed which effected 100% removal of the markings listed in Example 8 from alkyd enameled metal surfaces.

The bluish-white emulsion was subjected to the degreasing test method of Example 1 with the following results:

1st attack on greased slide at 3 sec.
30% removal of grease at 30 sec.
55% removal of grease at 1.0 min.
75% removal of grease at 1.5 min.
85–90% removal of grease at 2.0 min
95% removal of grease at 2.5 min.
100% removal of grease at 2.75 min.

EXAMPLE 15

An aqueous degreaser emulsion formulation was prepared having the following composition:

| Component | Wt. % |
|---|---|
| 2-Ethylhexoxyethanol (Ektasolve EEH, Kodak) | 20.0 |
| Soft $H_2O$ | 77.9 |
| Acusol 820, 30% total solids (Rohm & Haas) | 1.6 |
| Triethanolamine | 0.5 |
| | 100.0 |

The solvent, water and Acusol (acrylic acid/alkyl methacrylate copolymer) thickener were pre-emulsified under high shear stirring conditions. The triethanolamine was then added very slowly with vigorous stirring to thicken and emulsify the mixture. The mixture was subjected to 3-bladed, motor-driven stirring at full speed/high shear for 15 minutes to fully emulsify. The resulting composition was an intensely white, creamy emulsion having a pH of 7.01, a Brookfield viscosity (LV-#3 spindle, 30 rpm) of 2520 centipoise, a total solids content (theory) of 0.98% and a total actives content (theory) of 20.98%. The emulsion exhibited no flash point and had excellent stability.

At a 1:5 dilution with water, the emulsion effected 100% and easy removal of the markings listed in Example 8 from alkyd enameled metal surfaces.

The emulsion was subjected to the degreasing test method of Example 1 with the following results:

1st attack on greased slide at 7 sec.
25% removal of grease at 1.0 min.
45% removal of grease at 2.0 min.
60–65% removal of grease at 3.0 min.
75–80% removal of grease at 4.0 min.
95% removal of grease at 5.0 min.
100% removal of grease at 5.33 min.

EXAMPLE 16

Ten grams of guar gum powder (Aldrich) was added to 990 grams of soft water with stirring after which the hazy colloidal solution was stirred at room temperature for 1 hour. To the resulting viscous solution was added, with stirring, 0.05 g. Dowcil 75 powder and stirring continued until the preservative was fully dissolved and mixed. The hazy, colloidal solution had a Brookfield viscosity (LV-#3 spindle, 30 rpm) of 2890 centipoise and a pH of 8.67.

An aqueous degreaser emulsion formulation was prepared having the following composition:

| Component | Wt. % |
|---|---|
| Benzaldehyde | 20.0 |
| Guar gum (1.0 wt. % solution from above) | 79.8 |
| Isostearyl diethanolamide (Monamid 150-IS) | 0.2 |
| | 100.0 |

The above mixture including the isostearyl diethanolamide compatabilizing agent was placed in a 150 ml. beaker and stirred vigorously with a high speed, motor-driven, 3-bladed impellor for 30 minutes at room temperature. The resulting composition was an intense ivory-colored emulsion having a pH of 7.82, a Brookfield viscosity (LV-#3 spindle, 30 rpm) of 1970 centipoise, a total solids content (theory) of 1.00% and a total actives content (theory) of 21.0%. The emulsion exhibited no flash point and had excellent stability.

At a 1:5 dilution with water, a bluish-white colored emulsion was formed which effected 100% removal of the markings listed in Example 8 from alkyd enameled metal surfaces.

The bluish-white emulsion was subjected to the degreasing test method of Example 1 with the following results:

1st attack on greased slide at 1–2 sec.
33% removal of grease at 10 sec.
55% removal of grease at 20 sec.
70–75% removal of grease at 30 sec.
90% removal of grease at 40 sec.
100% removal of grease at 50 sec.

EXAMPLE 17

An aqueous degreaser emulsion formulation was prepared having the following composition:

| Component | Wt. % |
|---|---|
| Tri-n-butyl phosphate | 20.0 |
| Hydroxypropylmethyl cellulose (1.80% prepared as in Example 14) | 80.0 |
| | 100.0 |

The emulsification procedure employed in Example 14 was followed to produce an intensely white, thick emulsion having a pH of 8.66, a Brookfield viscosity (LV-#3 spindle, 12 rpm) of 5540 centipoise, a total solids content (theory) of 1.44% and a total actives content (theory) of 21.44%. The emulsion exhibited no flash point and had excellent stability.

At a 1:5 dilution with water, a white to bluish/white colored emulsion formed which effected 100% removal of the markings listed in Example 8 from alkyd enameled metal surfaces.

The latter diluted emulsion was subjected to the degreasing test method of Example 1 with the following results:

1st attack on greased slide at 1 sec.
35% removal of grease at 10 sec.
55–60% removal of grease at 20 sec.
80–85% removal of grease at 30 sec.
100% removal of grease at 40 sec.

EXAMPLE 18

An aqueous degreaser emulsion formulation was prepared having the following composition:

| Component | Wt. % |
|---|---|
| Dipropylene glycol mono-n-butyl ether (Dowanol DPnB) | 25.0 |
| Soft $H_2O$ | 72.3 |
| Acusol 820, 30% (Rohm & Haas) | 2.0 |
| Triethanolamine | 0.7 |
| | 100.0 |

The solvent, water and thickening agent were stirred to pre-emulsify the mixture. The triethanolamine was then added slowly with vigorous stirring to thicken and emulsify the mixture. 3-bladed, motor-driven stirring at full speed/high shear was continued for 15 minutes to fully emulsify the mixture. The resulting composition was an intensely white, creamy emulsion having a pH of 7.49, a Brookfield viscosity (LV-#3 spindle, 30 rpm) of 1930 centipoise, a total solids content (theory) of 1.2% and a total actives content (theory) of 26.2%. The emulsion exhibited no flash point and had excellent stability.

At a 1:3 dilution with water, an intensely white emulsion formed which effected 100% removal of the markings listed in Example 8 from alkyd enameled metal surfaces.

The later diluted emulsion was subjected to the degreasing test method of Example 1 with the following results:

1st attack on greased slide at <1 sec.
55–60% removal of grease at 10 sec.
100% removal of grease at 20 sec.

EXAMPLE 19

An aqueous degreaser emulsion formulation was prepared having the following composition:

| Component | Wt. % |
|---|---|
| Nitrobenzene | 15.0 |
| Hydroxyethyl cellulose, 1.25% colloidal solution (prepared as in Example 12) | 84.9 |
| Monamid 150-IS | 0.1 |
| | 100.0 |

The emulsification procedure described in Example 10 was followed with the Monamid 150-IS being incorporated as a compatabilizing agent. The resulting composition was an intensely bluish/white emulsion having a pH of 8.63, a Brookfield viscosity (LV-#3 spindle, 12 rpm) of 4970 centipoise, a total solids content (theory) of 1.16% and a total actives content (theory) of 16.16%.

At a 1:5 dilution with water, the intensely bluish/white emulsion which formed effected 100% removal of the markings listed in Example 8 from alkyd enameled metal surfaces.

The latter diluted emulsion was subjected to the degreasing test method of Example 1 with the following results:

1st attack on greased slide at 2 sec.
30% removal of grease at 30 sec.
55–60% removal of grease at 1.0 min.
75–80% removal of grease at 1.5 min.
90% removal of grease at 2.0 min.
100% removal of grease at 2.5 min.

EXAMPLE 20

Six grams of dispersible grade xanthan gum (Rhodopol 50 MD, R.T. Vanderbilt Co.) was slowly added with vigorous stirring to 993.7 g. of deionized water. To this was added with continuous stirring 0.05 g. Dowcil 75 powder which readily dissolved in the dispersion. After stirring for 5 minutes at room temperature, 0.3 g. of ammonium hydroxide was added dropwise and with continuous vigorous stirring, immediate thickening occurred. The mixture was stirred for an additional 10 minutes at room temperature. The final xanthan gum colloidal solution had a Brookfield viscosity (LV-#3 spindle, 30 rpm) of 1280 centipoise and a pH of 8.50.

An aqueous degreaser emulsion formulation was prepared having the following composition:

| Component | Wt. % |
|---|---|
| 2-Phenoxyethanol (Dowanol EPh) | 20.0 |
| Xanthan gum, 0.60% colloidal solution prepared as above described | 80.0 |
| | 100.0 |

The above mixture was placed in a 150 ml. beaker and vigorously stirred at full speed with a motor-driven 3-bladed impellor for 15 minutes at room temperature. The resulting composition was an intensely white colored emulsion having a pH of 8.42, a Brookfield viscosity (LV-#3 spindle, 30 rpm) of 1300 centipoise, a total solids content (theory) of 0.48% and a total actives content (theory) of 20.48%. The emulsion exhibited no flash point and had excellent stability.

At a 1:5 dilution with water, the formulation exists as a bluish/white colored emulsion which effected 100% removal of the markings listed in Example 8 from alkyd enameled metal surfaces.

The latter diluted emulsion was subjected to the degreasing test method of Example 1 with the following results:

1st attack on greased slide at 1 sec.
55% removal of grease at 10 sec.
100% removal of grease at 22 sec.

EXAMPLE 21

An aqueous degreaser emulsion formulation was prepared having the following composition:

| Component | Wt. % |
|---|---|
| Methylbenzene sulfonate (Eastman Kodak #5763) | 20.00 |
| Soft $H_2O$ | 77.45 |
| Acusol 820, 30% total solids (Rohm & Haas) | 2.00 |
| Triethanolamine | 0.55 |
| | 100.00 |

The solvent, water and Acusol thickener were pre-emulsified with stirring for 5 minutes. The triethanolamine was added slowly with vigorous stirring to thicken the mixture and the mixture was then emulsified using 3-bladed motor-driven stirring at full speed/high shear for 10 minutes. The resulting composition was an intensely white, creamy emulsion having a pH o 7.92, a Brookfield viscosity (LV-#3 spindle, 30 rpm) of 2920 centipoise, a total solids content (theory) of 1.15% and a total actives content (theory) of 21.15%. The emulsion exhibited no flash point and had excellent stability.

At a 1:5 dilution with water, a white colored emulsion formed which effected 100% removal of the markings listed in Example 8 from alkyd enameled metal surfaces.

The later diluted emulsion was subjected to the degreasing test method of Example 1 with the following results:

1st attack on greased slide at <1 sec.
60% removal of grease at 10 sec.
100% removal of grease at 18 sec.

EXAMPLE 22

A 3.0 wt. % aqueous solution of polyacrylamide (Aldrich, av. mol. wt. 5,000,000 to 6,000,000) was prepared by adding the requisite amount of polyacrylamide powder to stirred soft water at room temperature. Thereafter the suspension was warmed to 60° C. with stirring and maintained at this temperature, under continuous stirring, for 16 hours and thereafter cooled to room temperature. The resulting solution had a Brookfield viscosity (LV-#3 spindle, 30 rpm) of 2800 centipoise and a pH of 6.45.

An aqueous degreaser emulsion formulation was prepared having the following composition:

| Component | Wt. % |
|---|---|
| 1-Phenoxy-2-propanol (Dowanol PPh) | 20.00 |
| Polyacrylamide, 3.0% aq. solution prepared above | 79.93 |
| Dodecylbenzenesulfonic acid | 0.05 |
| Monoethanolamine | 0.02 |
| | 100.00 |

The above mixture (with the dodecylbenzenesulfonic acid and monoethanolamine functioning as a compatabilizing agent and for in situ neutralization) was vigorously stirred at full speed with a motor-driven 3-bladed impellor for 15 minutes at room temperature. The resulting composition was an intensely white, creamy emulsion having a pH of 8.05, a Brookfield viscosity (LV-#3 spindle, 30 rpm) of 3072 centipoise, a total solids content (theory) of 2.47% and a total actives content (theory) of 22.47%. The emulsion exhibited no flash point and had excellent stability.

At a 1:10 dilution with water, a pale bluish/white emulsion formed which effected 100% removal of the markings listed in Example 8 from alkyd enameled metal surfaces.

The latter diluted emulsion was subjected to the degreasing test method of Example 1 with the following results:

1st attack on greased slide at 1 sec.
45–50% removal of grease at 10 sec.
70% removal of grease at 20 sec.
90% removal of grease at 30 sec.
100% removal of grease at 37 sec.

EXAMPLE 23

An aqueous degreaser emulsion formulation was prepared having the following composition:

| Component | Wt. % |
|---|---|
| N,N-dimethylbenzylamine | 20.0 |
| Hydroxypropylmethyl cellulose, 1.80 wt. % (Methocel J5MS) prepared as in Example 14 | 80.0 |
| | 100.0 |

The above mixture was vigorously stirred at full speed with a motor-driven 3-bladed impellor for 15 minutes at room temperature. The resulting composition was an intensely white, creamy emulsion having a pH of 10.37, a Brookfield viscosity (LV-#3 spindle, 30 rpm) of 3100 centipoise, a total solids content (theory) of 1.44% and a total actives content (theory) of 21.44%. The emulsion exhibited no flash point and had excellent stability.

At a 1:5 dilution with water, an intensely bluish-white emulsion was formed. The emulsion was used to remove various markings from alkyd enameled metal surfaces with the following results:

| Marking | % Removal |
|---|---|
| Black felt tip Magic Marker pen | 95% |
| Black ballpoint pen | 100% |
| Blue ballpoint pen | 100% |
| Red (wax) china marker | 100% |
| #1 Hardness pencil | 100% |
| | 99% |

-continued

| Marking | % Removal |
|---|---|
| | composite score |

The diluted emulsion was subjected to the degreasing test method of Example 1 with the following results:

1st attack on greased slide at 1–2 sec.
25% removal of grease at 10 sec.
40–45% removal of grease at 20 sec.
60% removal of grease at 30 sec.
75% removal of grease at 40 sec.
85% removal of grease at 50 sec.
90–95% removal of grease at 1.0 min.
100% removal of grease at 1.25 min.

EXAMPLE 24

An aqueous degreaser emulsion formulation was prepared having the following composition:

| Component | Wt. % |
|---|---|
| Isophorone | 20.0 |
| Xanthan gum, 0.60% colloidal solution (Rhodopol 50 MD) prepared as in Example 20 | 80.0 |
| | 100.0 |

The above mixture was emulsified as described in Example 20. The resulting composition was a creamy, pale yellow colored emulsion having a pH of 8.39, a Brookfield viscosity (LV-#3 spindle, 30 rpm) of 1340 centipoise, a total solids content (theory) of 0.48% and a total actives content (theory) of 20.48%. The emulsion exhibited no flash point and had excellent stability.

At a 1:5 dilution with water, a pale white colored emulsion formed which effected 100% removal of the markings listed in Example 8 from alkyd enameled metal surfaces.

The latter diluted emulsion was subjected to the degreasing test method of Example 1 with the following results:

1st attack on the greased slide at 1 sec.
40% removal of grease at 10 sec.
70% removal of grease at 20 sec.
90–95% removal of grease at 30 sec.
100% removal of grease at 35 sec.

EXAMPLE 25

An aqueous degreaser emulsion formulation was prepared having the following composition:

| Component | Wt. % |
|---|---|
| Diethyl benzylphosphonate | 20.00 |
| Soft $H_2O$ | 77.45 |
| Acusol 820, 30% (Rohm & Haas) | 2.00 |
| Triethanolamine | 0.55 |
| | 100.00 |

The solvent, water and Acusol thickener were pre-emulsified with stirring for 5 minutes. The triethanolamine was then added dropwise with vigorous stirring to thicken and emulsify the mixture using 3-bladed motor-driven stirring at full speed/high shear action for 10 minutes. The resulting composition was a creamy, intensely white emulsion having a pH of 7.87, a Brookfield viscosity (LV-#3 spindle, 30 rpm) of 2060 centipoise, a total solids content (theory) of 1.15% and a total activities content (theory) of 21.15%. The emulsion exhibited no flash point and had excellent stability.

At a 1:5 dilution with water, a bluish white emulsion formed which effected 100% removal of the markings listed in Example 8 from alkyd enameled metal surfaces.

The latter diluted emulsion was subjected to the degreasing test method of Example 1 with the following results:

1st attack on greased slide at 1 sec.
33% removal of grease at 10 sec.
55% removal of grease at 20 sec.
75–80% removal of grease at 30 sec.
95% removal of grease at 40 sec.
100% removal of grease at 45 sec.

EXAMPLE 26

An aqueous degreaser emulsion formulation was prepared having the following composition:

| Component | Wt. % |
|---|---|
| 1-Phenoxy-2-propanol (Dowanol PPh) | 10.0 |
| Fumed silica ("Cab-O-Sil", Cabot Corp.) | 7.0 |
| Distilled water | 83.0 |
| | 100.0 |

The water and solvent were placed in a 150 ml. beaker equipped with a motor-driven 3-bladed impellor. While stirring the fumed silica was slowly introduced into the dispersion. After approximately ½ of the fumed silica had been added, the stirring rate was gradually increased to full speed as the remainder of the fumed silica was added. Thickening increased dramatically and true emulsification of the 1-phenoxy-2- propanol concurrently occurred. Vigorous stirring was continued for an additional 15 minutes. The resulting composition was an intensely white, somewhat thick emulsion having a pH of 5.05, a Brookfield viscosity (LV-#3 spindle, 12 rpm) of 9200 centipoise, a total solids content (theory) of 7.0% and a total actives content (theory) of 17.0%. The emulsion exhibited no flash point and had excellent stability.

At a 1:5 dilution with water, a bluish-white emulsion formed which effected 100% removal of the markings listed in Example 8 from alkyd enameled metal surfaces.

The latter diluted emulsion was subjected to the decreasing test method of Example 1 with the following results:

1st attack on greased slide at 1 sec.
33% removal of grease at 10 sec.
55–60% removal of grease at 20 sec.
80% removal of grease at 30 sec.
100% removal of grease at 42 sec.

EXAMPLE 27

An aqueous degreaser emulsion formulation was prepared having the following composition:

| Component | Wt. % |
|---|---|
| Benzothiazole | 15.0 |
| Hydroxyethyl cellulose, 1.25 wt. % Natrosol 250 HR prepared as in Example 12 | 85.0 |

-continued

| Component | Wt. % |
|---|---|
| | 100.0 |

The above mixture was vigorously stirred at full speed with a stirrer motor-driven 3-bladed impellor for 15 minutes at room temperature. The resulting composition was a light orange/amber colored emulsion having a pH of 8.05, a Brookfield viscosity (LV-#3 spindle, 12 rpm) of 6150 centipoise, a total solids content (theory) of 1.06% and a total actives content (theory) of 16.06%. The emulsion exhibited no flash point and had excellent stability.

At a 1:5 dilution with water, a light orange/amber colored emulsion formed which effected 100% removal of the markings listed in Example 1 from alkyd enameled metal surfaces.

The latter diluted emulsion was subjected to the degreasing test method of Example 1 with the following results:

1st attack on greased slide at 6–7 sec.
25–30% removal of grease at 1.0 min.
50% removal of grease at 2.0 min.
65–70% removal of grease at 3.0 min.
85% removal of grease at 4.0 min.
100% removal of grease at 4.83 min.

EXAMPLE 28

A 1.0 wt. % aqueous colloidal solution of sodium alginate ("Kelcosol", Kelco Corp. div. of Merck & Co.) was prepared by adding the requisite amount of sodium alginate powder in small increments to the vortex of stirred soft water at room temperature. The thickened colloidal solution was stirred for 0.5 hr. to effect total dissolution of the powder after which it was inhibited by the addition of 0.005 wt. % of Dowcil 75 powder with stirring. The resulting colloidal solution had a Brookfield viscosity (LV-#3 spindle, 30 rpm) of 2050 centipoise and a pH of 9.34.

An aqueous degreaser emulsion formulation was prepared having the following composition:

| Component | Wt. % |
|---|---|
| 1-Phenoxy-2-propanol (Dowanol PPh) | 15.00 |
| Sodium alginate, 1.0 wt. % prepared above | 84.95 |
| Tall oil fatty acid | 0.05 |
| | 100.00 |

The solvent, thickener and tall oil fatty acid compatabilizing agent were placed in a 150 ml. beaker and stirred vigorously with a high speed motor-driven 3-bladed impellor for 30 minutes at room temperature. The resulting composition was an intensely white, creamy emulsion having a pH of 8.67, a Brookfield viscosity (LV-#3 spindle, 30 rpm) of centipoise, a total solids content (theory) of 0.90% and a total actives content (theory) of 15.90%. The emulsion exhibited no flash point and had excellent stability.

At a 1:5 dilution with water, a bluish/white emulsion formed which effected 100% removal of the markings listed in Example 8 from alkyd enameled metal surfaces.

The latter diluted emulsion was subjected to the degreasing test method of Example 1 with the following results:

1st attack on greased slide at 1–2 sec.
30% removal of grease at 10 sec.
50% removal of grease at 20 sec.
70–75% removal of grease at 30 sec.
90% removal of grease at 40 sec.
100% removal of grease at 47 sec.

EXAMPLE 29

A 3.0 wt. % aqueous colloidal suspension of magnesium aluminum silicate (Magnebrite S, American Colloid Co.) was prepared by slowly adding, with vigorous stirring, the magnesium aluminum silicate powder flakes to the vortex of water stirred by a motor-driven 3-bladed impellor, employing the requisite amount of each component. Stirring was continued for a total of 4 hours at room temperature. The resultant tan colored suspension had a Brookfield viscosity (LV-#2 spindle, 60 rpm) of 61 centipoise and a pH of 9.77.

An aqueous degreaser emulsion formulation was prepared having the following composition:

| Component | Wt. % |
|---|---|
| Polypropylene glycol 1200, (2% aq. solubility) | 10.0 |
| Magnesium aluminum silicate, 3.0% aq. suspension prepared as above | 87.0 |
| Monoethanolamine | 2.7 |
| Sodium hydroxide, 50% | 0.3 |
| | 100.0 |

To the magnesium aluminum silicate suspension contained in a 150 ml. beaker, stirred by a stirrer motor driven 3-bladed impellor, was added the polypropylene glycol 1200 solvent. Next, the monoethanolamine was slowly added under vigorous stirring conditions (thickening), and finally the aqueous sodium hydroxide was added dropwise (further thickening). The resultant emulsion/suspension was stirred for an additional 30 minutes under high shear agitation to produce a tan colored, creamy emulsion having a pH of 12.23, a Brookfield viscosity (LV-#3 spindle, 30 rpm) of 1480 centipoise, a total solids content (theory) of 2.76% and a total actives content (theory) of 12.76%. The emulsion exhibited no flash point and had excellent stability.

At a 1:2 dilution with water, a tan colored emulsion was formed. The emulsion was used to remove various markings from alkyd enameled metal surfaces with the following results:

| Marking | % Removal |
|---|---|
| Black felt tip Magic Marker pen | 95% |
| Black ballpoint pen | 95% |
| Blue ballpoint pen | 100% |
| Red (wax) china marker | 100% |
| #1 Hardness pencil | 100% |
| | 98% composite score |

The diluted emulsion was subjected to the degreasing test method of Example 1 with the following results:

1st attack on greased slide at 1–2 sec.
25% removal of grease at 10 sec.
45% removal of grease at 20 sec.
60–65% removal of grease at 30 sec.
80% removal of grease at 40 sec.
90% removal of grease at 50 sec.

100% removal of grease at 1.08 min.

EXAMPLE 30

A 10.0 wt. % aqueous solution of polyvinylpyrrolidone (mol. wt. 360,000) was prepared by adding the requisite amount of polyvinylpyrrolidone powder slowly into the vortex of stirred soft water at room temperature. The thickened solution was stirred by a motor-driven 3-bladed impellor for 1 hour to effect total dissolution of the powder. The resultant solution had a Brookfield viscosity (LV-#3 spindle, 30 rpm) of 408 centipoise and a pH of 7.22. It was clear and colorless.

An aqueous degreaser emulsion formulation was prepared having the following composition:

| Component | Wt. % |
|---|---|
| 1-Phenoxy-2-propanol (Dowanol PPh) | 10.0 |
| Polyvinylpyrrolidone, 10.0% aq. sol. prepared above. | 90.0 |
| | 100.0 |

The above mixture was placed in a 150 ml. beaker and stirred vigorously with a high speed, motor-driven 3-bladed impellor for 30 minutes at room temperature. The resulting composition was an intensely white, creamy emulsion having a pH of 6.84, a Brookfield viscosity (LV-#3 spindle, 30 rpm) of 453 centipoise, a total solids content (theory) of 9.0% and a total actives content (theory) of 19.0%. The emulsion exhibited no flash point and had good stability.

At a 1:5 dilution with water, a bluish/white emulsion formed which effected 100% removal of various markings from alkyd enameled metal surfaces.

The latter diluted emulsion was subjected to the degreasing test method of Example 1 with the following results:

1st attack on greased slide at 1 sec.
45% removal of grease at 10 sec.
75–80% removal of grease at 20 sec.
100% removal of grease at 30 sec.

EXAMPLE 31

A 1.05 wt. % aqueous colloidal solution of sodium carboxymethyl cellulose (Aqualon Cellulose Gum, Type 7H) was prepared by slowly adding the requisite amount of the powder to the vortex of vigorously stirred soft water at room temperature. The aqueous solution rapidly thickened; some lumps of the powder/-gel sodium carboxymethyl cellulose remained, but these slowly went into solution during the 1.5 hours of vigorous stirring (3-bladed impellor, stirrer motor-driven). There resulted a clear, colloidal solution having a Brookfield viscosity (LV-#3 spindle, 12 rpm) of 5580 centipoise and a pH of 9.77. It was inhibited by the stirred addition of 0.005 wt. % Dowcil 75.

An aqueous degreaser emulsion formulation was prepared having the following composition:

| Component | Wt. % |
|---|---|
| α-Terpinol | 20.0 |
| Sodium carboxymethyl cellulose, 1.05% aq. sol. prepared as above | 79.9 |
| Tall oil fatty acid | 0.1 |
| | 100.0 |

The above mixture with the tall oil fatty acid compatabilizing agent was placed in a 150 ml. beaker and stirred vigorously with a high speed, motor-driven 3-bladed impellor for 30 minutes at room temperature. The resulting composition was an intensively white emulsion having a pH of 8.04, a Brookfield viscosity (LV-#3 spindle, 12 rpm) of 7750 centipoise, a total solids content (theory) of 0.94% and a total actives content (theory) of 20.94%. The emulsion exhibited no flash point and had excellent stability.

At a 1:5 dilution with water, a white colored emulsion formed which effected 100% removal of the various markings listed in Example 8 from alkyd enameled metal surfaces.

The latter diluted emulsion was subjected to the degreasing test method of Example 1 with the following results:

1st attack on greased slide at 1 sec.
35–45% removal of grease at 10 sec.
65% removal of grease at 20 sec.
90% removal of grease at 30 sec.
100% removal of grease at 35 sec.

EXAMPLE 32

To rapidly stirred (motor driven 3-beaded impellor) water was slowly added Carbopol 690 thickener in powder form. Stirring of the aqueous suspension was continued for 1 hour during which time dissolution of the Carbopol 690 thickener occurred, producing a hazy solution.

An aqueous hand degreaser cream/gel formulation was prepared having the following composition:

| Component | wt. % |
|---|---|
| Polyglycol 112-2 (Dow Chemical Co.) | 25.00 |
| Carbopol 690 thickener (B.F. Goodrich) | 0.25 |
| Triethanolamine | 0.18 |
| Soft water | 74.57 |
| | 100.00 |

Polyglycol 112-2, a viscous, oligomeric "oil", was added to the above-noted aqueous hydrocolloidal solution of Carbopol 690 thickener and the mixture preemulsified by vigorous stirring for 10 minutes at room temperature. Finally the triethanolamine was added dropwise with vigorous stirring to the preemulsion and the combined components emulsified under high shear stirring conditions for 10 minutes to produce a ready-to-use, intensely white/semi-translucent cream/gel having a pH of 6.68, a Brookfield viscosity (LV-#4 spindle, 6 rpm) of 87,000 centipoise, a total solids content (theory) of 0.43% and a total actives content (theory) of 25.43%. This very stable, odorless emulsion, when applied to the hands, had a smooth emollient feel. It readily emulsifies (dissolves) Takilube outside gear lubricant, automotive grease and oils from hands on rubbing hands together, then completely rinses in a stream of water, on continued rubbing. On drying (paper towel or cloth towel), the hands are thoroughly clean and soft.

EXAMPLE 33

A floor finish stripper emulsion formulation in concentrate form was prepared having the following composition:

| Component | Wt. % |
|---|---|
| Dipropylene glycol mono-n-butyl ether (Dowanol DPnB) | 20.0 |
| Acusol 820, 30% total solids (Rohm & Haas) | 3.0 |
| Monoethanolamine | 10.0 |
| Soft water | 67.0 |
| | 100.0 |

The water was charged into a motor-driven, 3-bladed impellor equipped 150 ml beaker. While stirring, the Acusol 820 thickener was slowly added followed by the Dowanol DPnB. Finally, the monoethanolamine was slowly added under high shear/vigorous stirring conditions and the resulting white colored, thickened emulsion was stirred at high speed for 15 minutes. The resulting composition was a white, creamy emulsion having a pH of 11.29, a Brookfield viscosity (LV-#3 spindle, 12 rpm) of 3170 centipoise, a total solids content (theory) of 1.1% and a total actives content (theory) of 30.9%. It exhibited good stability.

A portion of the above thickened emulsion concentrate was diluted 1:10 in water, affording a clear, colorless solution and used in the stripping of vinyl tile coated 4 times with Castleguard floor finish. When a wet film of the above-noted clear, colorless solution was applied (by wet pad application/swabbing motion) to the 4× coated tile and given a 10 minute (at ambient temperature) hold period to allow penetration and dissolution of the finish, followed by light scrubbing with a nylon mesh scrubbing pad and then finally flood water rinsed followed by air drying, the finish coating was totally, readily stripped from the tile.

EXAMPLE 34

The following ready-to-use concentrate composition was prepared as a safe, effective formulation for the removal of surface and subsurface asphalt, food, etc. stains; dyes; tire, heel, etc. marks; greases and waxes; and other colored soilants from polymer finished and/or polymer sealed resilient and non-resilient flooring.

| Component | wt. % |
|---|---|
| Dowanol DPnB | 10.0 |
| Monamid 150-IS | 0.1 |
| Hydroxypropylmethyl cellulose (Methocel J5M5, Dow Chemical Co.) prepared as in Example 14 | 89.9 |
| | 100.0 |

The above mixture was vigorously stirred at full speed with a motor-driven 3-bladed impellor for 5 minutes at room temperature. The resulting composition was a white colored, creamy emulsion having a pH of 8.62, a Brookfield viscosity (LV-#3 spindle, 12 rpm) of 3300 centipoise, a total solids content (theory) of 1.72% and a total actives content (theory) of 11.72%. The emulsion exhibited good to fair stability and may require infrequent shaking to maintain uniformity.

For the removal of surface marks and stains from finished and/or sealed flooring, the emulsion is applied to the mark or stain, allowed to work (dissolve, soften, emulsify, etc.) for 15 seconds, and immediately wiped off with a paper (or preferably cloth) towel using some wiping pressure. The towel is then turned and used to dry buff the spot which is then fully removed. For the removal of subsurface marks and stains, the same procedure is used but 30 seconds contact time of the emulsion with the spot is allowed before wiping and dry buffing. This effectively lifts subsurface spotting.

Among the preferred emulsion compositions of the invention may be mentioned the compositions of Examples 2, 6 and 33.

In view of the foregoing, it will be seen that the several objects of the invention are achieved and other advantageous results attained.

As various changes could be made in the above compositions and methods without departing from the scope of the invention, it is intended that all matter contained in the above description shall be interpreted as illustrative and not in a limiting sense.

What is claimed is:

1. A stable, aqueous degreaser emulsion composition consisting essentially of:

(a) at least one sparingly water soluble organic solvent characterized by:
  (i) having a water solubility in the range of approximately 0.05 to approximately 6 weight percent;
  (ii) not being a hydrocarbon or halocarbon;
  (iii) having one or more similar or dissimilar oxygen, nitrogen, sulfur, or phosphorus containing functional groups;
  (iv) being a solvent for hydrophobic soilants; and
  (v) being present in an amount exceeding its aqueous solubility up to approximately 30% by weight of said composition;

(b) a viscosity modifying thickener being present in an amount between approximately 0.1 and 10 wt. % whereby when the mixture of said organic solvent and thickener are subjected to sufficiently energetic mixing and/or shear conditions, the initially formed, unstable 2-phase agglomerate is transformed into a uniformly opaque, stable emulsion having a viscosity of at least 500 centipoise at a temperature of 70° F. (21° C.) and a droplet size of approximately 0.1 to 3 millimicrons; and (c) water.

2. A stable, aqueous degreaser emulsion composition as set forth in claim 1 wherein said emulsion has a viscosity in the range of at least 500 to 10,000 centipoise.

3. A stable, aqueous degreaser emulsion composition as set forth in claim 1 wherein said viscosity modifying thickener is selected from the group consisting of acrylic acid/alkyl methacrylate copolymers, carboxy acrylic polymers, guar gums, xanthan gums, hydroxyethyl cellulose, hydroxypropyl cellulose, hydroxypropylmethyl cellulose, carboxymethyl cellulose, sodium carboxymethyl cellulose, bentonite clays, magnesium aluminum silicates, polyethylene glycols, polyethylene oxide, fumed silica, polyacrylic acid crosslinked with polyalkenyl polyethers, polyacrylamide, polyvinylpyrrolidone, poly (methylvinyl ether/maleic) anhydride, polyacrylic acids, copolymers and latex emulsions, vinyl ether/maleic anhydride copolymers, ethylene/maleic anhydride copolymers, poly(acrylamidopropane sulfonic acid), polyvinyl alcohol, partially hydrolyzed polyvinyl acetate, poly (naphthylene sulfonic acid/formaldehyde condensate, sodium salt), ammonium alginate and sodium alginate.

4. A stable, aqueous degreaser emulsion composition as set forth in claim 1 wherein said organic solvent is selected from the group consisting of esters, alcohols, ketones, aldehydes, ethers, and nitriles.

5. A stable, aqueous degreaser emulsion composition as set forth in claim 1 wherein said solvent is selected from the group consisting of 2-phenoxyethanol, benzyl alcohol, 1-phenoxy-2-propanol, butyl cellosolve acetate, benzaldehyde, tri-n-butyl phosphate, dipropylene glycol monobutyl ether, isophorone, β-phenylethanol, and α-terpinol.

6. A stable, aqueous degreaser emulsion composition as set forth in claim 3 wherein said viscosity modifying thickener is a carboxy acrylic polymer.

7. A stable, aqueous degreaser emulsion composition as set forth in claim 3 wherein said viscosity modifying thickener is selected from the group consisting of hydroxyethyl cellulose, hydroxypropyl cellulose, hydroxypropylmethyl cellulose and carboxymethyl cellulose.

8. A stable, aqueous degreaser emulsion composition as set forth in claim 3 wherein said viscosity modifying thickener is polyethylene oxide.

9. A stable, aqueous degreaser emulsion composition as set forth in claim 3 wherein said viscosity modifying thickener is magnesium aluminum silicate.

10. A stable, aqueous degreaser emulsion composition as set forth in claim 1 wherein said viscosity modifying thickener contains free acidic group and the composition additionally contains a neutralizing base.

11. A stable, aqueous degreaser emulsion composition as set forth in claim 1 wherein said organic solvent is 1-phenoxy-2-propanol.

12. A stable, aqueous degreaser emulsion composition as set forth in claim 1 wherein said organic solvent is 2-phenoxyethanol.

13. A stable, aqueous degreaser emulsion composition as set forth in claim 1 wherein said organic solvent is dipropylene glycol mono-n-butyl ether.

14. A stable, aqueous degreaser emulsion composition consisting essentially of:

(a) 1-phenoxy-2-propanol in an amount exceeding its aqueous solubility up to approximately 30% by weight of said composition;

(b) polyethylene oxide in an amount between approximately 0.1 and 10 wt. % whereby when the mixture of said 1-phenoxy-2-propanol and polyethylene oxide are subjected to sufficiently energetic mixing and/or shear conditions, the initially formed, unstable agglomerate is transformed into a uniformly opaque, stable emulsion having a viscosity of at least 1000 centipoise at a temperature of 70° F. (21° C.) and a droplet size of approximately 0.1 to 3 millimicrons; and (c) water.

15. A stable, aqueous degreaser emulsion composition consisting essentially of:

(a) 1-phenoxy-2-propanol in an amount exceeding its aqueous solubility up to approximately 25–30% by weight of said composition;

(b) an acrylic acid/alkyl methacrylate copolymer in an amount between approximately 0.1 and 10 wt. % whereby when the mixture of said 1-phenoxy-2-propanol and copolymer are subjected to sufficiently energetic mixing and/or shear conditions, the initially formed, unstable agglomerate is transformed into a uniformly opaque, stable emulsion having a viscosity of at least 1000 centipoise at a temperature of 70° F. (21° C.) and a droplet size of approximately 0.1 to 3 millimicrons; and (c) water.

16. A stable, aqueous degreaser emulsion composition consisting essentially of:

(a) 1-phenoxy-2-propanol in an amount exceeding its aqueous solubility up to approximately 30% by weight of said composition;

(b) magnesium aluminum silicate in an amount between approximately 0.1 to 10 wt. % whereby when the mixture of said 1-phenoxy-2-propanol and magnesium aluminum silicate are subjected to sufficiently energetic mixing and/or shear conditions, the initially formed, unstable agglomerate is transformed into a uniformly opaque, stable emulsion having a viscosity of at least 1000 centipoise at a temperature of 70° F. (21° C.) and a droplet size of approximately 0.1 to 3 millimicrons; and (c) water.

17. A stable, aqueous degreaser emulsion composition consisting essentially of:

(a) dipropylene glycol mono-n-butyl ether in an amount exceeding its aqueous solubility up to approximately 30% by weight of said composition;

(b) an acrylic acid/alkyl methacrylate copolymer in an amount between approximately 0.1 and 10 wt. % whereby when the mixture of said dipropylene glycol mono-n-butyl ether and copolymer are subjected to sufficiently energetic mixing and/or shear conditions, the initially formed, unstable agglomerate is transformed into a uniformly opaque, stable emulsion having a viscosity of at least 1000 centipoise at a temperature of 70° F. (21° C.) and a droplet size of approximately 0.1 to 3 millimicrons;

(c) monoethanolamine; and (d) water.

* * * * *